US006168351B1

(12) United States Patent
Rainey

(10) Patent No.: US 6,168,351 B1
(45) **Date of Patent: *Jan. 2, 2001**

(54) RETAINING WALL ANCHORING SYSTEM

(75) Inventor: Thomas L. Rainey, Acworth, GA (US)

(73) Assignee: Anchor Wall Systems, Inc., Minnetonka, MN (US)

( * ) Notice: Under 35 U.S.C. 154(b), the term of this patent shall be extended for 0 days.

This patent is subject to a terminal disclaimer.

(21) Appl. No.: 09/261,420

(22) Filed: Mar. 3, 1999

Related U.S. Application Data

(60) Provisional application No. 60/086,843, filed on May 27, 1998.

(51) Int. Cl.[7] ..... E02D 29/02

(52) U.S. Cl. ..... 405/262; 405/284; 405/286

(58) Field of Search ..... 405/262, 284, 405/285, 286

(56) References Cited

U.S. PATENT DOCUMENTS

| | | | |
|---|---|---|---|
| D. 350,611 | 9/1994 | Scales | D25/114 |
| 1,947,151 * | 2/1934 | Caples | 405/262 |
| 3,490,242 * | 1/1970 | Schnabel, Jr. | 405/262 |
| 3,541,798 * | 11/1970 | Schnabel, Jr. | 405/262 |
| 4,470,728 | 9/1984 | Broadbent | 405/284 |
| 4,490,075 | 12/1984 | Risi et al. | 405/273 |
| 4,530,622 | 7/1985 | Mercer | 405/258 |
| 4,601,148 | 7/1986 | Risi et al. | 52/284 |
| 4,690,588 * | 9/1987 | Berger | 405/262 |
| 4,815,897 | 3/1989 | Risi et al. | 405/284 |
| 4,824,293 | 4/1989 | Brown et al. | 405/284 |
| 4,914,876 | 4/1990 | Forsberg | 52/169.4 |
| 4,917,543 * | 4/1990 | Cole et al. | 405/262 |
| 5,044,834 | 9/1991 | Janopaul, Jr. | 405/284 |
| 5,064,313 | 11/1991 | Risi et al. | 405/284 |
| 5,066,169 | 11/1991 | Gavin et al. | 405/284 |
| 5,248,226 | 9/1993 | Risi et al. | 405/284 |
| 5,257,880 | 11/1993 | Janopaul, Jr. | 405/284 |
| 5,294,216 | 3/1994 | Sievert | 405/286 |
| 5,368,414 * | 11/1994 | Miller | 405/262 |
| 5,417,523 | 5/1995 | Scales | 405/284 |
| 5,511,910 | 4/1996 | Scales | 405/262 |
| 5,522,682 | 6/1996 | Egan | 405/262 |
| 5,540,525 | 7/1996 | Miller et al. | 405/284 |
| 5,568,998 | 10/1996 | Egan et al. | 405/262 |
| 5,568,999 | 10/1996 | Egan et al. | 405/262 |
| 5,580,191 | 12/1996 | Egan | 405/262 |
| 5,595,460 | 1/1997 | Miller et al. | 405/284 |
| 5,619,835 | 4/1997 | Bailey, II et al. | 52/606 |
| 5,622,456 | 4/1997 | Risi et al. | 405/284 |
| 5,673,530 | 10/1997 | Bailey, II | 52/606 |
| 5,697,735 | 12/1997 | Egan | 405/262 |
| 5,827,015 | 10/1998 | Woolford et al. | 405/286 |
| 5,921,715 * | 7/1999 | Rainey | 405/262 |

FOREIGN PATENT DOCUMENTS

B93/02549 12/1993 (GB) .

* cited by examiner

*Primary Examiner*—Eileen D. Lillis
*Assistant Examiner*—Frederick L. Lagman
(74) *Attorney, Agent, or Firm*—Thomas, Kayden, Horstemeyer & Risley, L.L.P.

(57) ABSTRACT

A retaining wall anchoring system for a segmental retaining wall comprising a plurality of tieback rods adapted to be embedded into soil or rock with a proximal portion extending therefrom, at least one elongated force distribution member positionable directly adjacent the proximal portion of at least one of the tieback rods, a washer positionable about the proximal portions of the tieback rod in abutment with the force distribution member, and a fastener fixedly securable to the proximal portion of the tieback rod to securely clamp the washer against the force distribution member such that tensile forces imposed on the tieback rod are transmitted to the force distribution member so as to distribute these forces throughout a portion of the retaining wall.

27 Claims, 4 Drawing Sheets

RETAINING WALL ANCHORING SYSTEM

CROSS REFERENCE TO RELATED APPLICATION

This application claims the benefit of the filing dates of U.S. patent application Ser. No. 08/846,440, filed Apr. 30, 1997, (now U.S. Pat. No. 5,921,715, issued Jul. 13, 1999). U.S. patent application Ser. No. 09/049,627, filed Mar. 27, 1998, now U.S. Pat. No. 6,089,793 and U.S. Provisional Application Serial No. 60/086,843, filed May 27, 1998.

FIELD OF THE INVENTION

The invention relates generally to earth reinforcement. More particularly, the invention relates to a segmental retaining wall anchoring system for securing segmental retaining walls.

BACKGROUND OF THE INVENTION

Segmental earth retaining walls are commonly used for architectural and site development applications. Such walls are subjected to very high pressures exerted by lateral movements of the soil, temperature and shrinkage effects, and seismic loads. Therefore, the backfill soil typically must be braced with tensile reinforcement members.

Often, elongated structures, commonly referred to as geogrids or reinforcement fabrics, are used to provide this reinforcement. Geogrids often are configured in a lattice arrangement and are constructed of a metal or polymer, while reinforcement fabrics are constructed of woven or nonwoven polymers (e.g., polymer fibers). These reinforcement members typically extend rearwardly from the wall and into the soil. The weight of the soil constrains the fabric from lateral movement to thereby stabilize the retaining wall.

SUMMARY OF THE INVENTION

Briefly described, the present invention relates to a retaining wall anchoring system for a segmental retaining wall comprising a plurality of tieback rods adapted to be embedded into soil or rock with a proximal portion extending therefrom. The system includes at least one elongated force distribution member positionable directly adjacent the proximal portion of the tieback rods, at least one washer positionable about the proximal portions of at least one tieback rod in abutment with the force distribution member, and at least one fastener fixedly securable to the proximal portion of the tieback rod to securely clamp the washer against the force distribution member such that tensile forces imposed on the tieback rod are transmitted to the distribution member so as to distribute these forces throughout a portion of the retaining wall.

The above described apparatus therefore can be used to construct a segmental retaining wall system comprising a retaining wall having a plurality of wall blocks stacked in ascending courses with a plurality of the wall blocks being provided with interior openings that are aligned with each other to form an inner passageway within the retaining rods to securely clamp the washer against the force distribution member such that tensile forces imposed on the tieback rods are transmitted to the force distribution member so as to distribute the tensile forces throughout a portion of the retaining wall.

In addition, the apparatus can be used to construct a segmental retaining wall system comprising a retaining wall having a plurality of wall blocks stacked in ascending courses to form an interior surface and an exterior surface, a plurality of tieback rods adapted to be embedded into soil or rock with a proximal portion extending therefrom, the proximal portion of each tieback rod extending toward the interior surface of the retaining wall, at least one elongated force distribution member positioned adjacent the interior surface of the retaining wall and directly adjacent the proximal portion of at least one tieback rod, a washer positioned about the distal portion of the tieback rod in abutment with the force distribution member, a fastener fixedly secured to the proximal portion of the tieback rod to securely clamp the washer against the force distribution member, and a reinforcement member connected to the force distribution member and being securely attached to the retaining wall such that tensile forces imposed on the tieback rods are transmitted to the force distribution member and through the reinforcement member to the retaining wall so as to distribute the tensile forces throughout a portion of the retaining wall.

DETAILED DESCRIPTION

Figure 1:
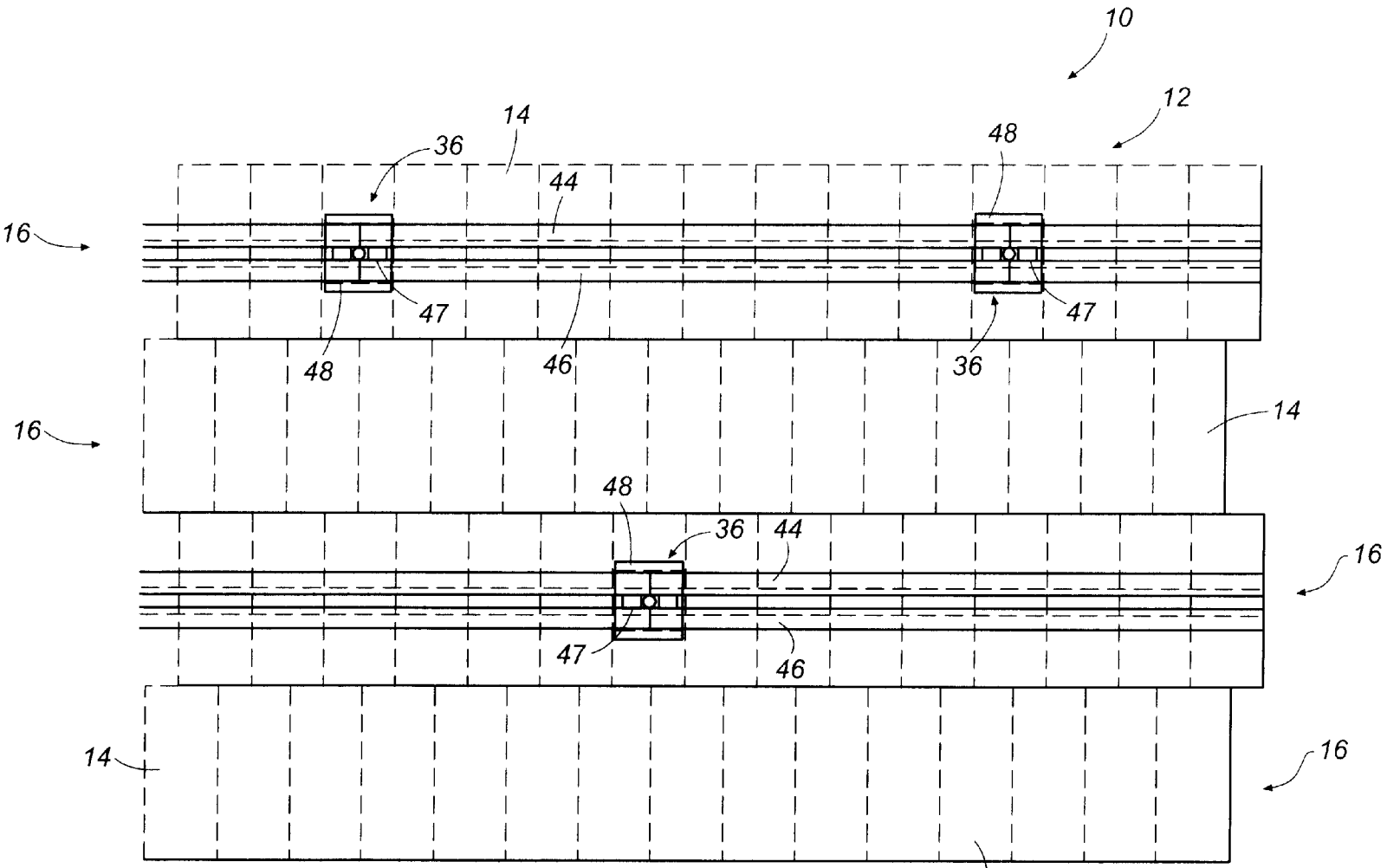
FIG. 1 is a front view of a retaining wall secured with an anchoring system constructed in accordance with the present invention.
Figure 3:
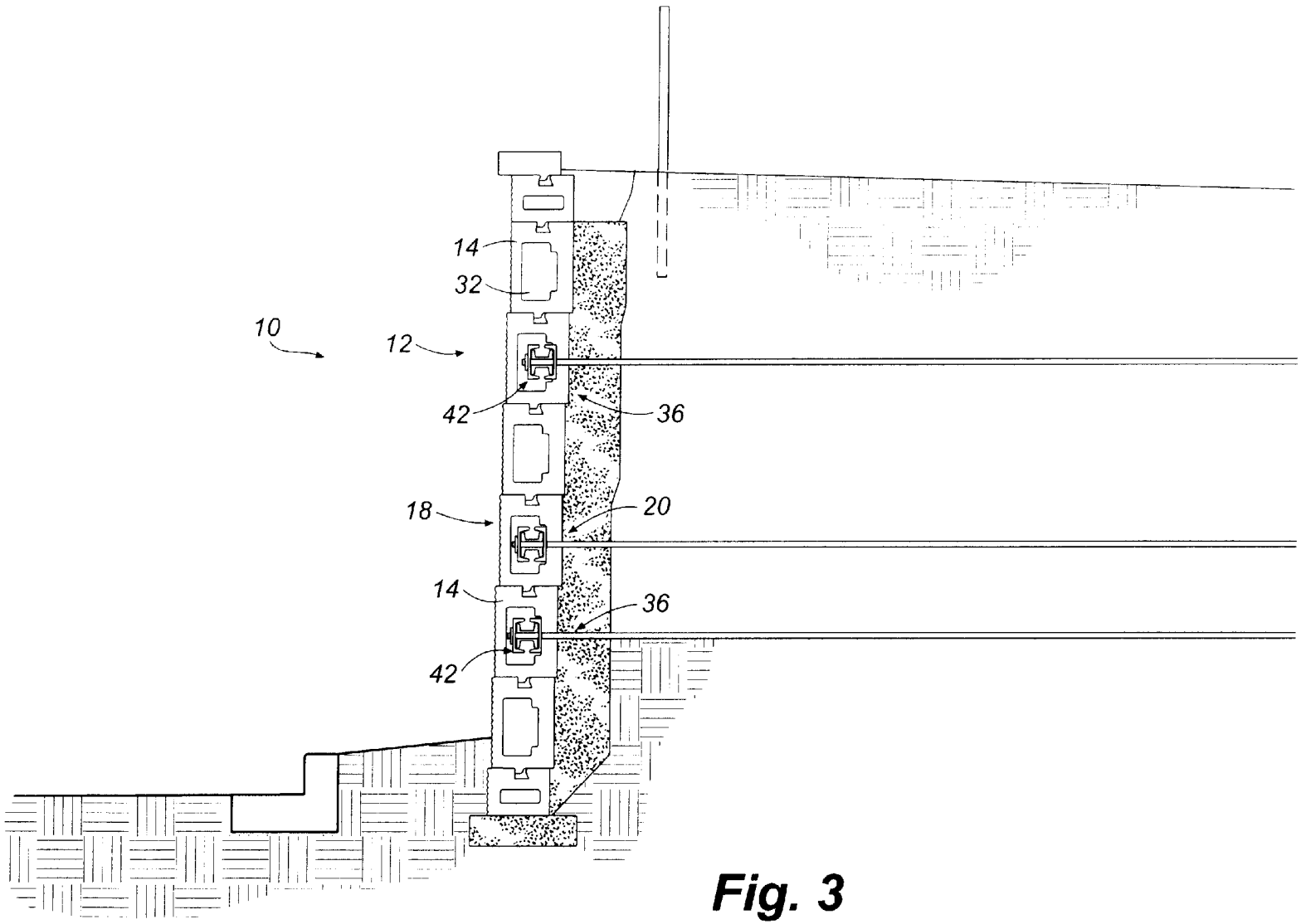
FIG. 3 is a partial cross-sectional view of a retaining wall secured with an anchoring system constructed in accordance with the present invention.

Referring now in detail to the drawings, in which like numerals indicate corresponding parts throughout the several views, FIG. 1 illustrates a modular retaining wall 10 secured with a first embodiment 12 of an anchoring system constructed in accordance with the present invention. As depicted in this figure, the retaining wall 10 comprises a plurality of wall blocks 14 that are stacked atop each other in ascending courses 16. When stacked in this manner, the wall blocks 14 together form an exterior surface 18 of the wall 10 which faces outwardly away from an earth embankment, and an interior surface 20 of the wall 10 which faces inwardly toward the embankment (FIG. 3). Typically, the blocks 14 are stacked in a staggered arrangement as shown in FIG. 1 to provide greater stability to the wall 10.

Generally speaking, the blocks 14 are substantially identical in size and shape for ease of block fabrication and wall construction, although it will be understood that unidentical blocks could be used, especially for cap blocks or base blocks. In a preferred configuration, each block 14 is configured so as to mate with at least one other block 14 when the blocks are stacked atop one another to form the retaining wall 10. This mating restricts relative movement between vertically adjacent blocks in at least one horizontal direction. To provide for this mating, the blocks 14 can include locking means 22 that secure the blocks together to further increase wall stability. More particularly, each block 14 can include a lock channel 24 and a lock flange 26 that are configured so as to positively lock with each other when the blocks 14 are stacked on top of each another as disclosed in co-pending U.S. application Ser. No. 09/049,627, which is hereby incorporated by reference into the present disclosure. When the blocks 14 include lock channels 24 and flanges 26, the individual lock channels typically form a continuous lock channel that extends the length of the lower of two mating courses when the blocks are aligned side-by-side within each course 16. Similarly, the lock flanges 26 form a continuous lock flange that extends the length of the upper of the mating courses 16 which is received by the continuous lock channel of the lower of the mating courses.

Although the blocks 14 preferably are provided with such locking means 22, it will be appreciated that the anchoring system of the present invention can be used with substantially any segmental retaining wall blocks. By way of example, the present system could be used with any of the blocks produced by Anchor Wall Systems, Inc. such as any block of the Anchor Diamond® and/or Anchor Vertica® product lines, or any block disclosed in U.S. Pat. No. 5,827,015, which is hereby incorporated by reference into the present disclosure. Moreover, the present system could be utilized with the segmental blocks produced by other manufacturers such as Keystone, Mesa, Versa-Lok, Newcastle, and Piza. Irrespective of the particular configuration of the wall blocks 14, each of the wall blocks typically includes an interior opening 32 that either extends through the block horizontally (side-to-side) or vertically (top-to-bottom). When the blocks 14 are correctly aligned in their respective courses 16, these openings 32 form continuous elongated passageways 34. In that, as described below, the passageways 34 typically are only used for anchoring system attachment, it is to be appreciated that only the blocks 14 that receive the system's components need be provided with such openings 32.

Figure 2:
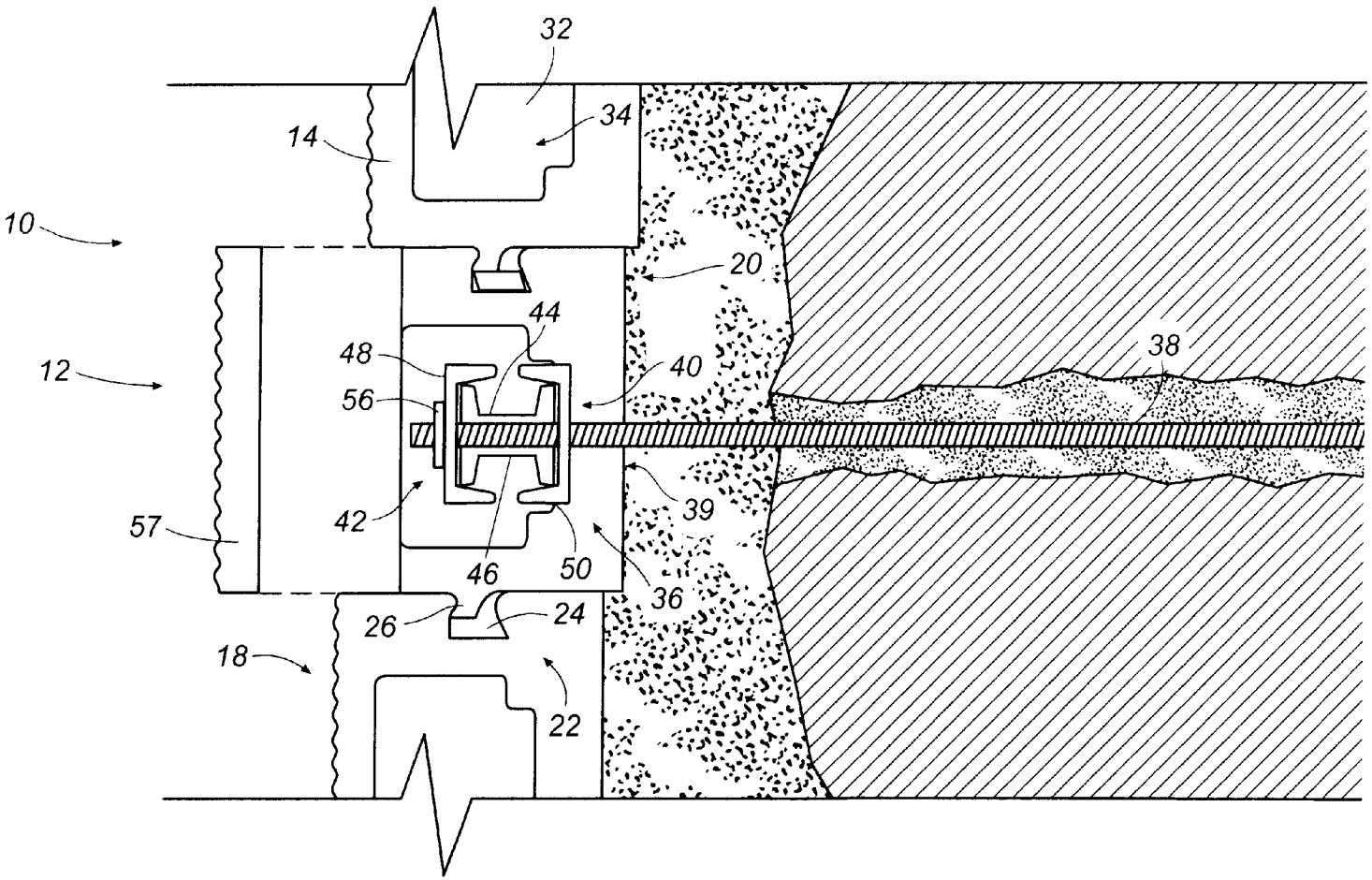
FIG. 2 is a partial cross-sectional view of a retaining wall which shows a tieback connection of an anchoring system constructed in accordance with the present invention.

As indicated in FIGS. 1–3, the retaining wall 10 is secured in several predetermined points with tieback connections 36. Typically, each tieback connection 36 is spaced approximately 10 feet apart horizontally from each other to form rows of tieback connections that are approximately 2.5 feet apart vertically from each other. Accordingly, each tieback rod 38 is embedded into the soil and/or rock in these intervals. As shown in FIG. 2, each tieback rod 38 extends through an opening 39 formed in the rear surface of its respective wall block 14 such that a proximal portion 40 of the rod 38 extends into the continuous elongated passageway. Also positioned within the passageway 34 is a tieback rod attachment mechanism 42. The attachment mechanism 42 normally includes a pair of elongated force distribution members 44, 46 that extend from one tieback rod 26 to the next along the passageway 34 and which are positioned above and below the tieback rods 38 as indicated in FIG. 1. Typically, each force distribution member 44, 46 comprises an elongated channel beam that is flanged so as to cooperate more readily with washers described below. Arranged in this manner, each passageway 34 having tieback rods 38 extending therein includes a plurality of force distribution members 44, 46 aligned end to end both above and below the rods. To maintain parallel spacing between the force distribution members 44, 46, the attachment mechanism 42 can include spacers 47 that are positioned adjacent each rod 38 on both sides of the rod as indicated in FIG. 1. Normally, the height of these spacers 47 generally approximates the diameter of the tieback rods 38.

As shown in FIG. 2, a pair of flanged washers 48, 50 partially surround the upper and lower pairs of force distribution members 44 and 46, and are fitted about each tieback bar 38. To accommodate the rearmost 50 of the washers, each wall block 14 accommodating a tieback rod 38 normally is provided with an inner channel 54 that is sized and configured for receipt of the washer 50. Threaded onto each tieback rod 38 is a conventional threaded fastener 56 such as a nut which, when fully tightened, urges the washers 48, 50 inwardly to securely hold the force distribution members 44, 46 in position, thereby securing the rod to the wall 10. Normally, this tightening is achieved by accessing the interior of the block 14 by removing a face covering portion 57 of the block. Once fully tightened, the fastener 56 can be bonded in place with epoxy to prevent its inadvertent loosening. After the fastener 56 has been fixed in place, the face covering portion 57 of the block 14 can be secured to the block so that it matches the other blocks forming the wall. Configured in this manner, each tieback connection 36 evenly distributes any forces exerted on the tieback rods 38 throughout the wall 10 to greatly improve wall integrity.

Figure 4:
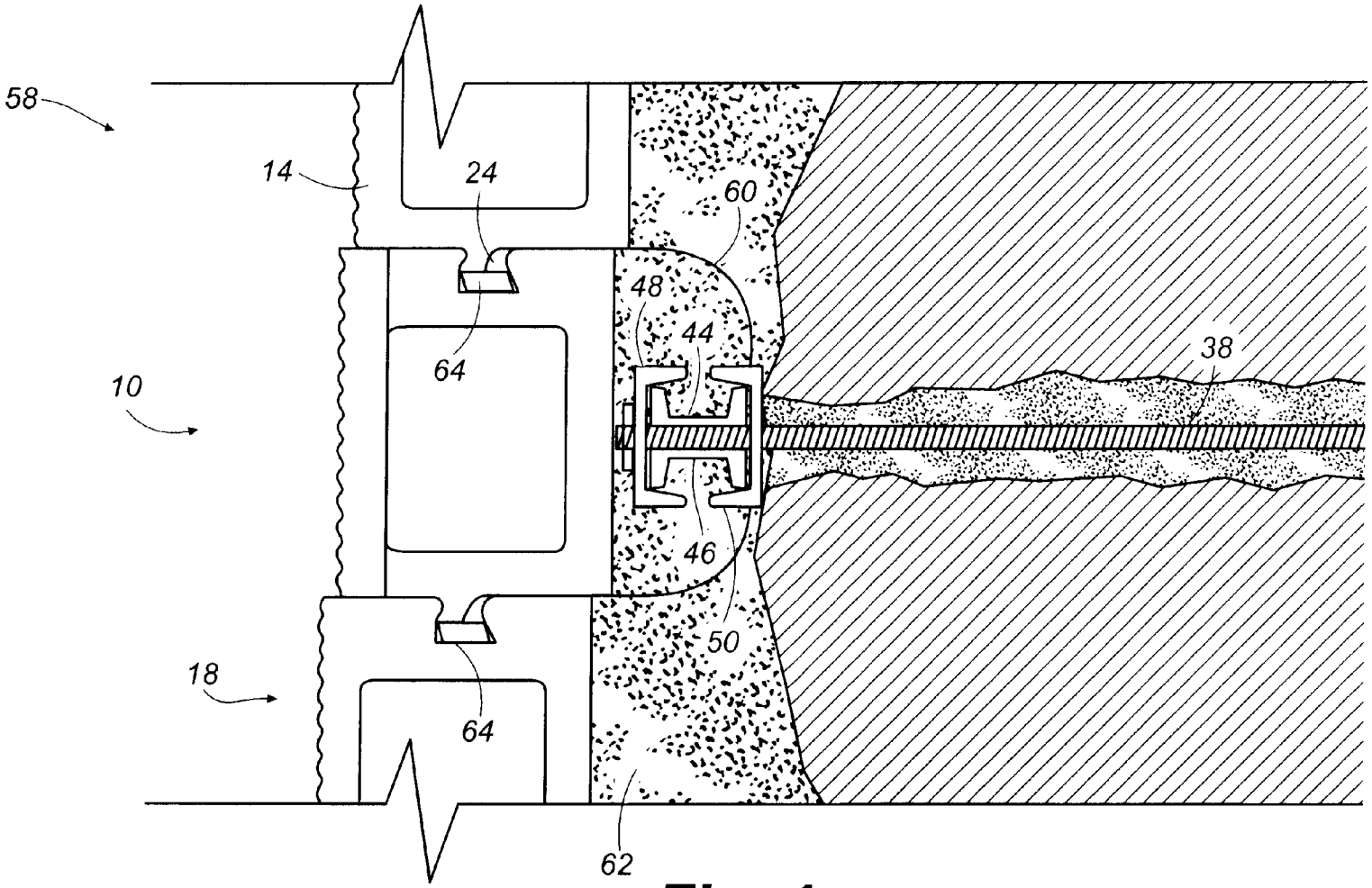
FIG. 4 is a partial cross-sectional view of a retaining wall which shows a tieback connection of an anchoring system constructed in accordance with the present invention.

FIG. 4 illustrates a second embodiment 58 of an anchoring system constructed in accordance with the present invention. This embodiment is structurally similar to the system depicted in FIGS. 1–3 and described above. Accordingly, the force distribution members 44, 46, flanged washers 48, 50, as well as the fastener 56, are used to secure the tieback rods 38 to the wall 10. However, in this embodiment, the rods 38 are secured with a reinforcement member 60 such as a geogrid wrap instead of directly to a wall block 14 such that the reinforcement member 60 is positioned outside of but adjacent to the interior surface 20 of the wall. Because of this arrangement, the blocks 14 need not comprise interior openings 32, as in the first embodiment. Preferred for the construction of the reinforcement member 60 is geogrid material that comprises flexible fabric composed of a polymeric material such as polypropylene or high tenacity polyester. As shown most clearly in FIG. 4, the reinforcement member 60 extends from the exterior surface 18 of the retaining wall 10, into a lock channel 24 of the lower adjacent wall block 14, out from the wall and into a portion of the stone fill 62 formed between the wall and the soil and/or rock, wraps around the force distribution members 44, 46, and then extends back underneath the upper adjacent block 14 (into the wall), into the lock channel 24 of the upper adjacent block, and back to the exterior surface of the wall 18, tracing a substantially C-shaped path.

In the wall system illustrated in FIG. 4, the reinforcement member 60 is locked to the wall 10 with a pair of retaining bars 64 that are positioned in the two lock channels 24 adjacent the tieback rod 38. These retaining bars 64 lie atop the reinforcement member 60 and holds it against the rear walls of the locking channels 24 to prevent the reinforcement member from being pulled out from the retaining wall 10. Although such retaining means are preferred, it will be understood that other types of retaining means could be used. When a tensile force is applied to the tieback rod 38 and translated to the reinforcement member 60, the retaining bars 64 are urged towards the rear wall of the channels 24, locking the reinforcement member in place. Thus, like the system of the first embodiment, the anchoring system of the second embodiment similarly distributes the forces exerted by the soil and/or rock of the embankment throughout the retaining wall 10.

While preferred embodiments of the invention have been disclosed in detail in the foregoing description and drawings, it will be understood by those skilled in the art that variations and modifications thereof can be made without departing from the spirit and scope of the invention. For instance, although the anchoring system of the first embodiment herein is described and shown in use with a retaining wall having horizontal inner passageways, it is to be appreciated that this systems easily could be adapted for use with a retaining wall having vertical inner passageways.

What is claimed is:

1. A retaining wall anchoring system for a segmental retaining wall, comprising:

a plurality of tieback rods adapted to be embedded into soil or rock with a proximal portion extending therefrom;

at least one force distribution member positionable directly adjacent said proximal portion of at least one of said tieback rods;

at least one washer positionable about said proximal portion of at least one of said tieback rods in abutment with said at least one force distribution member; and at least one fastener fixedly securable to said proximal portion of at least one of said tieback rods to securely clamp said at least one washer against said at least one force distribution member such that tensile forces imposed on said tieback rod is transmitted to said at least one force distribution member so as to distribute the tensile forces throughout a portion of the retaining wall;

wherein said proximal portion of each tieback rod, said at least one force distribution member, said at least one washer, and said at least one fastener are adapted to be positioned in an internal passageway formed in the retaining wall.

2. The system of claim 1, wherein said system includes at least two force distribution members, one being adapted to be positioned to a first side of said tieback rods and the other being adapted to be positioned to a second side of said tieback rods.

3. The system of claim 2, further comprising at least one spacer positionable between said force distribution members which maintains parallel spacing between said force distribution members.

4. The system of claim 2, wherein said force distribution members are elongated channel beams.

5. The system of claim 4, wherein said elongated channel beams are flanged.

6. The system of claim 1, wherein said system comprises at least 2 washers, one washer being positionable on an inner side of said at least one force distribution member and another being positionable on an outer side of said at least one force distribution member at said at least one of said tieback rods.

7. The system of claim 6, wherein each washer is flanged so as to partially surround said at least one force distribution member.

8. The system of claim 1, wherein said proximal portion of each tieback rod is threaded and said at least one fastener comprises a threaded nut.

9. A segmental retaining wall system, comprising:

a retaining wall having a plurality of wall blocks stacked in ascending courses, a plurality of said wall blocks of at least one of said courses being provided with interior openings that are aligned with each other to form an inner passageway within said retaining wall;

a plurality of tieback rods adapted to be embedded into soil or rock with a proximal portion extending therefrom, said proximal portion of each tieback rod extending into said inner passageway formed within said retaining wall;

at least one force distribution member positioned within said inner passageway directly adjacent said proximal portion of at least one of said tieback rods;

at least one washer positioned about said proximal portion of said at least one of said tieback rods in abutment with said at least one force distribution member; and at least one fastener fixedly secured to said proximal portion of said at least one of said tieback rods to securely clamp said at least one washer against said at least one force distribution member such that tensile forces imposed on said tieback rod is transmitted to said at least one force distribution member so as to distribute the tensile forces throughout a portion of said retaining wall.

10. The system of claim 9, wherein said system includes at least two force distribution members disposed within said inner passage of said retaining wall, one being positioned to a first side of said tieback rod and the other being positioned to a second side of said tieback rod.

11. The system of claim 10, further comprising at least one spacer positioned between said force distribution members, said at least one spacer maintaining parallel spacing between said force distribution members.

12. The system of claim 10, wherein said force distribution members are elongated channel beams.

13. The system of claim 12, wherein said elongated channel beams are flanged.

14. The system of claim 9, wherein said system comprises at least two washers, one of said washers being in firm abutment with an inner side of said at least one force distribution member and another being in firm abutment with an outer side of said at least one force distribution member at said tieback rod so as to clamp said force distribution member therebetween.

15. The system of claim 14, wherein each washer is flanged so as to partially surround said force distribution member.

16. The system of claim 9, wherein said proximal portions of said tieback rods are threaded and said at least one fastener comprises a threaded nut.

17. A segmental retaining wall system, comprising:

a retaining wall having a plurality of wall blocks stacked in ascending courses to form an interior surface and an exterior surface;

a plurality of tieback rods adapted to be embedded into soil or rock with a proximal portion extending therefrom, said proximal portion of each tieback rod extending toward said interior surface of said retaining wall;

at least one force distribution member positioned adjacent said interior surface of said retaining wall and directly adjacent said proximal portion of at least one tieback rod;

at least one washer positioned about said proximal portion of said at least one tieback rod in abutment with said at least one force distribution member;

at least one fastener fixedly secured to said proximal portion of said at least one tieback rod to securely clamp said at least one washer against said at least one force distribution member; and a reinforcement member connected to said at least one force distribution member and being securely attached to said retaining wall such that tensile forces imposed on said tieback rods are transmitted to said at least one force distribution member and through said reinforcement member to said retaining wall so as to distribute the tensile forces throughout a portion of said retaining wall.

18. The system of claim 17, wherein said system includes at least two force distribution members, one being positioned to a first side of said at least one tieback rod and the other being positioned to a second side of at least one tieback rod.

19. The system of claim 18, further comprising at least one spacer positioned between said force distribution members, said at least one spacer maintaining parallel spacing between said force distribution members.

20. The system of claim 18, wherein said force distribution members are elongated channel beams.

21. The system of claim 20, wherein said elongated channel beams are flanged.

22. The system of claim 17, wherein said system comprises at least two washers, one washer being in firm abutment with an inner side of said at least one force distribution member and another being in firm abutment with an outer side of said at least one force distribution member at said at least one tieback rod so as to clamp said elongated force distribution member therebetween.

23. The system of claim 22, wherein said at least one washer is flanged so as to partially surround said force distribution member.

24. The system of claim 17, wherein said proximal portions of said tieback rods are threaded and said at least one fastener comprises a threaded nut.

25. The system of claim 17, wherein said reinforcement member is constructed of geogrid material.

26. The system of claim 17, further comprising retaining means for securing said reinforcement member to said retaining wall.

27. The system of claim 26, wherein said retaining means comprise a lock channel provided in each of a plurality of said wall blocks and at least one retainer bar disposed within at least one of said lock channels.

* * * * *

UNITED STATES PATENT AND TRADEMARK OFFICE

CERTIFICATE OF CORRECTION

PATENT NO. : 6,168,351 B1
DATED : January 2, 2001
INVENTOR(S) : Rainey

It is certified that error appears in the above-identified patent and that said Letters Patent is hereby corrected as shown below:

Title page,
Item [60], Related U.S. Application Data, "Provisional application No. 60/086,843, filed on May 27, 1998." should read -- Provisional application No. 60/086,843, filed on May 27, 1998, a continuation-in-part of application No. 08/846,440, filed on Apr. 30, 1997, now U.S. Pat. No. 5,921,715, and a continuation-in-part of application No. 09/049,627, filed on Mar. 27, 1998, now U.S. Pat. 6,338,597. --

Column 1,
Lines 6-11, "This application claims the benefit of the filing dates of U.S. patent application Ser. No. 08/846,440, filed Apr. 30, 1997, (now U.S. Pat. No. 5,921,715, issued Jul. 13, 1999). U.S. patent application Ser. No. 09/049,627, filed Mar. 27, 1998, now U.S. Pat. No. 6,089,793 and U.S. Provisional Application Serial No. 60/086,843, filed May 27, 1998." should read -- This application claims the benefit of the filing date of U.S. Provisional Application Serial No. 60/086,843, filed May 27, 1998, and is a continuation-in-part of U.S. patent application Ser. No. 08/846,440, filed Apr. 30, 1997, (now U.S. Pat. No. 5,921,715, issued Jul. 13, 1999) and is a continuation-in-part of U.S. patent application Ser. No. 09/049,627, filed Mar. 27, 1998, (now U.S. Pat. No. 6,338,597, issued Jan. 15, 2002). --
Lines 59-60, "within the retaining rods to securely" should read -- within the retaining wall, a plurality of tieback rods having proximal portions extending into the inner passageway, an elongated force distribution member positioned within the inner passageway directly adjacent the proximal portion of at least one of the tieback rods, a washer positioned about the promixal portion of at least one of the tieback rods in abutment with the force distribution member, and a fastener fixedly secured to the proximal portion of one of the tieback rods to securely --

Signed and Sealed this

First Day of March, 2005

JON W. DUDAS
*Director of the United States Patent and Trademark Office*